United States Patent [19]

Schmidt

[11] 4,111,339

[45] Sep. 5, 1978

[54] MOUNTING CUP FOR AEROSOL VALVES

[75] Inventor: Ingo Schmidt, Grosshausen Germany

[73] Assignee: Thomas GmbH, Langenselbold, Germany

[21] Appl. No.: 477,330

[22] Filed: Jun. 7, 1974

Related U.S. Application Data

[63] Continuation of Ser. No. 139,403, May 3, 1971, abandoned.

[30] Foreign Application Priority Data

May 3, 1970 [DE] Fed. Rep. of Germany ..... 2021643

[51] Int. Cl.[2] ..... B65D 83/14

[52] U.S. Cl. ..... 222/394

[58] Field of Search ..... 222/396, 394, 402.1, 222/402.11; 277/9.5; 220/358

[56] References Cited

U.S. PATENT DOCUMENTS

| | | | |
|---|---|---|---|
| 3,048,307 | 8/1962 | Michel | 222/402.11 X |
| 3,180,374 | 4/1965 | Muller | 222/396 X |
| 3,452,906 | 7/1969 | Daniels | 222/402.1 |

FOREIGN PATENT DOCUMENTS

| | | | |
|---|---|---|---|
| 659,524 | 10/1951 | United Kingdom | 220/358 |

*Primary Examiner*—Robert B. Reeves
*Assistant Examiner*—John P. Shannon
*Attorney, Agent, or Firm*—Larson, Taylor and Hinds

[57] ABSTRACT

A mounting cup for aerosol valves comprising a cupola member having an annular base, means provided said cupola for receiving an aerosol valve, a cylindrical shoulder integral at its bottom edge with the base of said cupola member and concentric with the side of said cupola member so as to form an annular space between said cupola member and said annular shoulder, a ring collar integral with the top edge of said cylindrical shoulder, the peripheral edge of said collar being downwardly curved to define an annular channel, a groove at the circumference of said cylindrical shoulder formed by an inwardly arched portion of the wall of said cylindrical shoulder, said groove being positioned substantially opposite said downwardly curved portion of said ring for receipt therebetween of a ring packing.

5 Claims, 5 Drawing Figures

FIG. 1
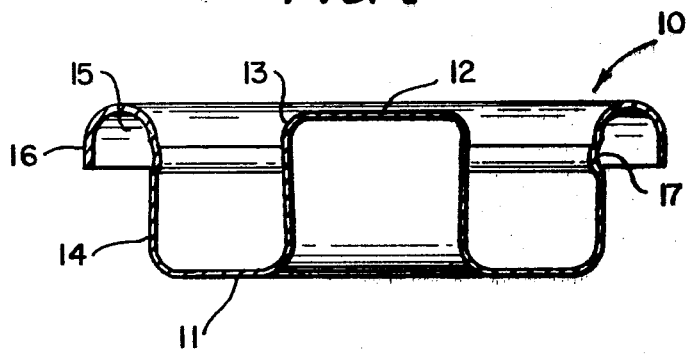
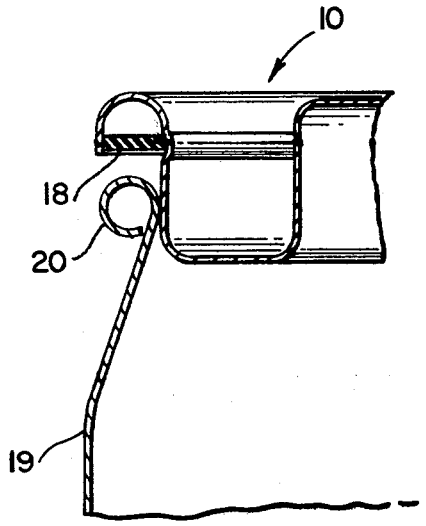
FIG. 2
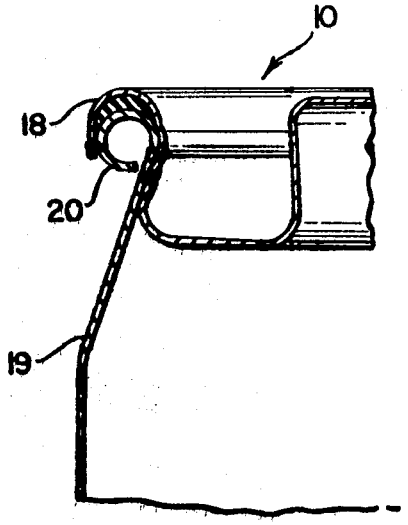
FIG. 3

MOUNTING CUP FOR AEROSOL VALVES

This is a continuation of application Ser. No. 139,403 filed May 3, 1971 now abandoned.

The invention relates to a mounting cup for aerosol valves. More particularly the invention pertains to a mounting cup having an annular channel for the reception of an annular gasket which cooperates with the lip or open edge of aerosol cans.

Aerosol cans from which a liquid underpressure can be sprayed by depressing the spray button are used to an ever increasing extent in many different fields. The spray button as part of the aerosol valve is mounted in the aforementioned mounting cup. The valve is closing the can.

The complete valve assembly, i.e. mounting cup and aerosol valve, is inserted in the container opening after filling and is held firmly and sealingly in the can by so-called "clinching"; i.e. where a normally cylindrical shoulder element of the mounting cup is mechanically expanded, thus interlocking the cup and the can.

Mounting cups and ring packings or seals as well as the containers therefor are regularly ordered from outside sources. The mounting cups and ring packings, however, must be shipped separately since the ring packings have a tendency during transportation to slip from the cylindrical shoulder of the cup. Consequently, the processing of the cups is rendered difficult and, furthermore, the distinct possibility exists that even after the valve cup is placed on the filled container, it will slip and assume an incorrect position during the "clinching". A relatively low processing speed as well as greater waste are a consequence of this shortcoming.

Attempts have already been made to remedy this problem by selecting the inside diameter of the ring packings in such a way that the packing is seated with a pre-tension on the shoulder of the cup. Unfortunately, packings selected in this manner are readily displaced from their normally flat position and again difficulties arise during closing of the container.

In many cases one operates mounting cups having gaskets flowed into the annular channel defined by a downwardly curved ring collar on the mounting cup instead of operating with a separate ring packing. These flowed-in gaskets, adhere to the wall of the channel and can generally not be used on containers made of aluminium.

It has also been know, in the case of spray valves employing a cup which merely overlaps the container, to provide the terminal edge of the container with a radial flange which reaches behind the packing and prevents any slipping off of the packing from the container. For the purpose of supporting the packing on said container, the container is provided with a more or less flat supporting edge and a cylindrical flange ring adjoining it. In the case of such a flange on mounting cups of the type to which this invention relates, however, the required free terminal edge of the shoulder surface is missing. Also, attachment of an inside flange on the collar of the cup cannot be made where the valve cup is to be used with a container provided with a rolled edge at its mouth since the flange would impede connection of the valve cup onto the container.

It is the object of the invention, therefore, to provide a mounting cup of the aforementioned type wherein separate ring packings or gaskets can be pulled onto the cups by the cup manufacturer without departing from the normally flat shape. Another object of the invention is to provide a mounting cup that can be supplied as a finished unit to the processor without there being any danger of the packing slipping out during transportation or when placed upon the filled container. A further object of the invention is to provide a mounting cup which is capable of easy placement upon containers provided with rolled edges at their mounths without placement itself being impeded.

These and other objects of the invention are achieved by a mounting cup comprising a cupola member having an annular base, means provided said cupola for receiving an aerosol valve, a cylindrical shoulder integral at its bottom edge with the base of said cupola member and concentric with the side of said cupola member so as to form an annular space between said cupola member and said annular shoulder, a ring collar integral with the top edge of said cylindrical shoulder, the peripheral edge of said collar being downwardly curved to define an annular channel, a groove at the circumference of said cylindrical shoulder formed by an inwardly arched portion of the wall of said cylindrical shoulder, said groove being positioned substantially opposite said downwardly curved portion of said ring for receipt therebetween of a ring packing.

The following advantages are obtained by the present invention:

1. Ring packings will not drop out of the annular channel of the mounting cup. Thus, it is possible to insert the valve packing at the plant of the producer of the mounting cup or head and to transport them as a unit to the processor.

2. The speed of the machines for closing the containers can be increased because the limitation on output caused by ring packings that drop out is eliminated.

3. The ring packing may be selected in such a way in regard to its inside diameter that it lies untensed in its mounted state and thus flatly in the groove or above it. Mistakes during closure of the container due to dislocated packings will be avoided.

4. Waste in the case of filling the containers due to slantingly seated ring packings will be decreased.

As a result of the inward curvature of the groove or grooves the outside diameter of the cylindrical shoulder can be adapted precisely to the opening diameter of the container that is to be closed without there being any necessity of exerting a special pressure on the cup during its placement. Nevertheless, the packing prior to placement of the cup and closure of the container will be safely held in the groove without dislocation.

In an advantageous embodiment of the invention, a single circular groove can be provided. It also is possible, however, to distribute several grooves at the circumference of the cylindrical shoulder at a circumferential distance from one another, as long as these grooves will have a length sufficient for the resilient fitting of the corresponding ring sections of the packings without substantial dislocation of the sections.

The invention is to be explained in more detail by reference to the attached drawing wherein:

FIG. 1 is a cross section through a mounting cup according to the invention with a circular groove;

FIG. 2 is a partial cross section of the cup according to FIG. 1 with an inserted packing during the placement cup on the beaded opening edge of an aerosol can or container;

FIG. 3 is a cross section similar to FIG. 2 after the placement and closure of the container;

Figure 4:
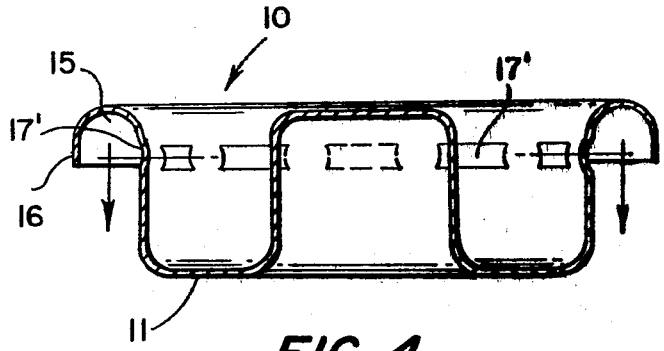
FIG. 4 is a cross section similar to FIG. 1 of another embodiment of a valve head or cup of the invention having several grooves distributed over the periphery of the shoulder surface.

Referring to the drawing, the mounting cup indicated generally as 10 comprises an annular bottom or base 11 from which rises a cupola 13 in the inner area thereof. The cupola receives a spray valve, not shown, by means of a perforation 12 provided the top of the cupola 13. On the outside periphery of the base 11, a cylindrical shoulder 14 starts, and is bent back at its upper end to form a ring collar 16 which defines an annular channel 15.

As shown particularly in FIG. 1, the cylindrical shoulder 14 is provided with a circular groove 17 approximately at the level of the edge of the ring collar, which groove is formed by an inward arching of the wall of the cylindrical shoulder 14 so that the outside diameter of cylindrical shoulder 14 at the grooved portion is smaller than the outside diameter of the remaining cylindrical shoulder 14.

Referring to FIG. 2, a flat ring packing 18 having an inside diameter corresponding to the previously mentioned outside diameter of the grooved portion of the cylindrical shoulder 17, is inserted in groove 17. Consequently, ring packing 18 is prevented from sliding from the cylindrical shoulder 14 during transportation of the cup as well as during its placement on the container to be closed.

Placement of cup 10 equipped with ring packing 18 on a container 19 is shown in FIGS. 2 and 3. The container 19 tapers conically and has a rolled edge 20 at its mouth or open end. The cross section of rolled edge 20 is largely adapted to that of the annular channel 15 so that upon pressing of cup 10 down against the folled edge 20, the ring packing 18 is seized by the latter and is pressed into the annular channel 15 following the curvature. In this position the diameter of cylindrical shoulder 14 is mechanically widened by means of the so-called "clinching" and, as a result of that, the cup is secured in closed position.

As becomes clear particularly from FIG. 2, the inward arching of groove 17 makes possible a precise adaptation of the outside diameter of cylindrical shoulder 14 to the diameter of the opening of the container. As a result of this feature, when the cup 10 is pressed onto the container, ring packing 18 is prevented from jamming between the cylindrical shoulder 14 and the opening of the container and from reaching a position which would be unfavorable for a perfect sealing. In addition, practice has shown that the groove will practically completely disappear during "clinching".

Figure 5:
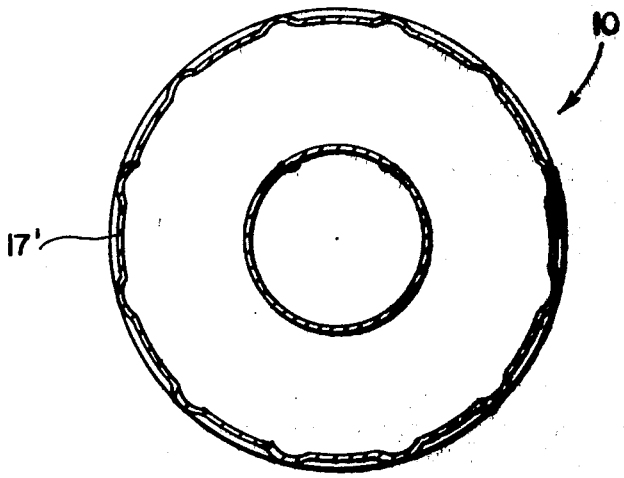
FIG. 5 is a section taken along line V—V in FIG. 4.

The embodiment of the mounting cup shown in FIGS. 4 and 5, differs from the embodiment of FIGS. 1 to 3 by the arrangement of several grooves 17' distributed at intervals along the circumference of the cylindrical shoulder at a circumferential distance from one another. At the same time, the peripheral circumference of the grooves 17' in relation to the intermediate ungrooved distances is selected in such a way that a flat ring packing pulled onto the cup fits with its corresponding sections in the grooves 17' under its own tension to essentially prevent dislocation and slipping out of the cup in the same manner as the embodiment of FIGS. 1 to 3.

It is claimed:

1. A valve lid for spray nozzles comprising a cupola member having an annular base extending radially outwardly from the lowermost peripheral edge of the cupola, said cupola being provided with means for receiving a spray nozzle, an upstanding cylindrical wall integral at its bottom edge with the base of said cupola member concentric with the side of said cupola member so as to form an upwardly opening annular space between said cupola member and said upstanding cylindrical wall, a ring collar integral with the top edge of said upstanding cylindrical wall, the peripheral edge of said collar being downwardly curved to define a downwardly opening annular channel, a groove at the circumference of said upstanding cylindrical wall formed by an inwardly arched portion of said wall said inwardly arched portion being radial to the axis of said cupola, said groove being positioned substantially opposite said downwardly curved portion of said ring collar and spaced downwardly from the apex of said curved collar, a flat ring packing fitting in said groove under its own tension and extending radially outwardly from the external surface of said groove to the internal surface of said downwardly curved portion near the tip thereof for axial displacement out of said groove and against the apex section of said curved collar when placing the valve lid onto a container to be closed by the lid whereby said ring packing will be deflected according to the cross-sectional form of said ring collar.

2. The valve lid of claim 1 wherein said groove is a single circular groove.

3. The valve lid of claim 1 wherein a plurality of the grooves are provided at the circumference of the upstanding cylindrical wall at circumferential distances one from another.

4. The valve lid of claim 1 wherein the groove is located at substantially the level of the downwardly curved edge of said ring collar.

5. The valve lid of claim 1 in combination with a container having a tapered conical neck portion, said neck portion having a rolled lip at the opening, said rolled lip having a diameter enabling receipt of said rolled lip into the annular channel of said valve lid in friction-fitting engagement therewith.

* * * * *